United States Patent [19]

Gailitis

[11] 4,260,080

[45] Apr. 7, 1981

[54] CONTINUOUS SPRAY DEVICE FOR AEROSOL VALVES

[75] Inventor: Adolph R. Gailitis, Winchester, Mass.

[73] Assignee: Summit Packaging Systems, Inc., Manchester, N.H.

[21] Appl. No.: 113,398

[22] Filed: Jan. 18, 1980

[51] Int. Cl.[3] ..... B65D 83/14

[52] U.S. Cl. ..... 222/402.14; 222/402.21

[58] Field of Search ..... 222/402.13, 402.14, 222/402.15, 402.21, 402.22, 402.23; 239/577; 251/103, 104–108; D9/258, 291

[56] References Cited

U.S. PATENT DOCUMENTS

| | | | |
|---|---|---|---|
| D. 216,950 | 3/1970 | Beck | D9/258 |
| 3,081,918 | 3/1963 | Scoggin, Jr. et al. | 222/402.15 X |
| 3,330,447 | 7/1967 | Doblin | 222/402.13 |

*Primary Examiner*—Charles A. Marmor

*Attorney, Agent, or Firm*—Dallett Hoopes

[57] ABSTRACT

Mushroom-shaped actuator has depending latch of sufficient flexibility so that the actuator may be pressed to cause the latch to engage the edge of the aerosol valve mounting cup lip and hold the valve "on". Conversely, by finger pressure on the opposite side of the actuator, the latch may be disengaged from the edge permitting the valve to return to the non-dispensing condition.

3 Claims, 6 Drawing Figures

CONTINUOUS SPRAY DEVICE FOR AEROSOL VALVES

BACKGROUND OF THE INVENTION

1. Field of the Invention

This invention relates to actuators for aerosol dispensers. More specifically, this invention relates to actuators designed to hold the aerosol valve in a discharging condition. The invention finds use in the field of dispensers for fumigators, insecticides, room deodorants, and has other uses.

2. Description of the Prior Art

The prior art includes disclosures of continuous spray devices for aerosol valves. Many different arrangements have been disclosed. However, the arrangement closest to the present structure is disclosed in U.S. Pat. No. 3,081,918, issued to Scoggin, Jr. et al on Mar. 19, 1963.

In Scoggin, a sleeve fits over the standard aerosol valve structure, the sleeve having a hook integrally molded with it with a hinging connection between the sleeve and the hook. In use, the prior art device is slipped over the stem and the valve is tilted so that the hook is able to engage over the mounting cup lip or bead. The hooking as described holds the valve in the "on" condition but the hook may be disengaged to permit the valve stem to return to vertical position, turning the valve off. The unhooking is accomplished by pressing the valve further in the direction in which it is tilted and simultaneously maneuvering the hook away from the mounting cup lip. This is generally a two-handed operation.

SUMMARY OF THE INVENTION

Under the present invention, the actuator is in the form of a more or less rigid mushroom-shaped structure, the hub of the mushroom extending over the valve stem, and the actuator having a downward latch integrally molded with the actuator and adapted to flex so that its lower end, comprising a hook, engages over the lip of the mounting cup when the actuator is tilted in the direction of the latch. The latch thus holds the actuator in tilted condition, keeping the valve in dispensing condition.

Under the present invention, all that is necessary to disengage the latch is to press the actuator on its side opposite the latch. This pulls the latch hook away from the lip and permits the valve stem to return to vertical "off" condition.

BRIEF DESCRIPTION OF THE DRAWINGS

Further objects and features of the invention will be apparent from a reading of the following specification including the claims and examination of the attached drawings. The specification and drawings disclose a non-limiting embodiment of the invention.

In the drawings.

Figure 1:
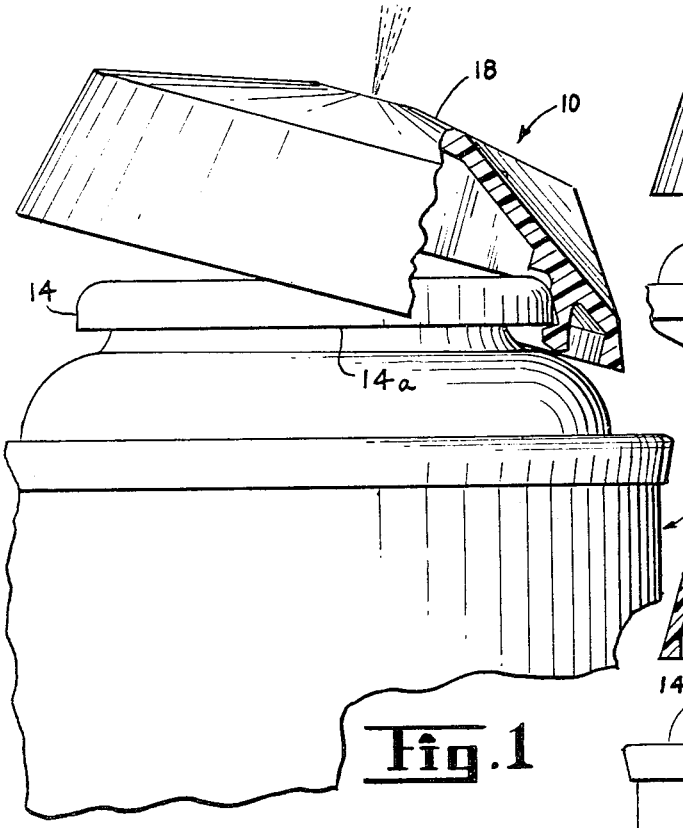
FIG. 1 is a fragmentary view of a dispenser including the actuator embodying the invention. The actuator is tilted to the "on" condition and a portion of the actuator is broken away to show the engagement of the latch with the lip of the mounting cup.
Figure 3:
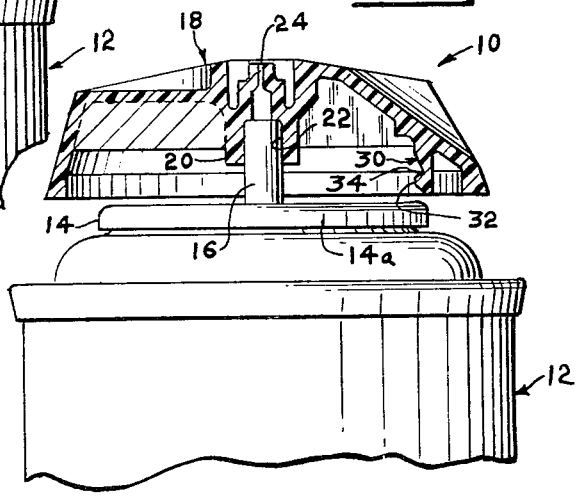
FIG. 3 is similar to FIG. 2 but shows the actuator in section.
Figure 4:
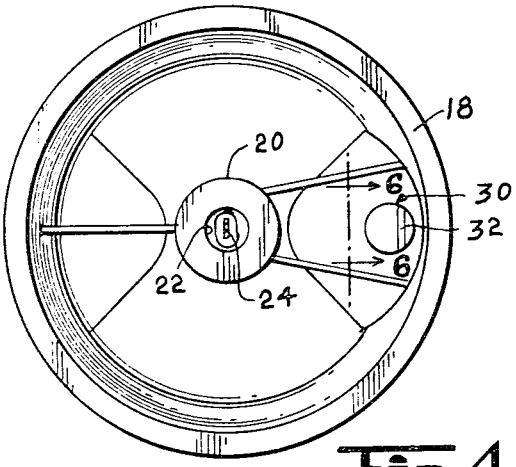
FIG. 4 is a view of the underside of an actuator embodying the invention.
Figure 5:
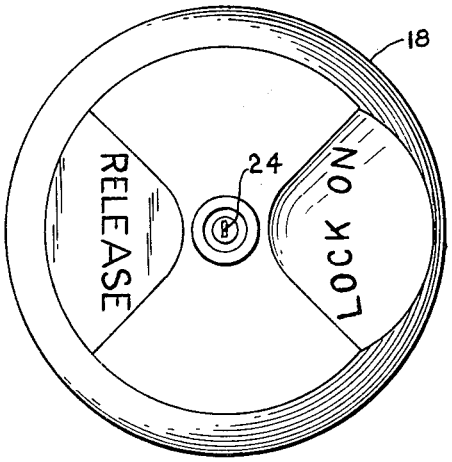
FIG. 5 is a top plan view of such an actuator.
Figure 6:
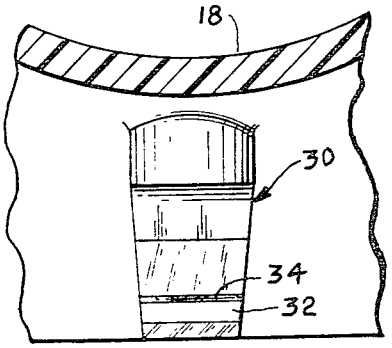
FIG. 6 is an enlarged fragmentary sectional view taken on the line 6—6 of FIG. 4.

Referring more specifically to the drawings, a dispenser embodying the invention is generally indicated 10 in FIG. 1. It comprises a container 12 having at the upper end thereof a valve mounting cup 14 which is crimped over an opening at the top of the can and terminates downwardly in an edge 14*a*. Extending upwardly from the center of the mounting cup 14 is a conventional valve stem 16 (FIG. 3). The valve with which the stem 16 is associated is preferably of the tilt-type exemplified in the U.S. Pat. No. 3,158,298, issued Nov. 24, 1964 to Joseph Briechle.

Mounted on the valve stem 16 is the actuator 18 which is generally of mushroom-shape and has a central downward hub 20 formed with an inlet passage 22 connected to a dispensing orifice 24. The inlet passage in the use of the actuator fits snugly over the stem 16 with the result that pressure on one side of the actuator 18 causes the tilting of the valve stem 16 to actuate the valve, dispensing product through the orifice 24.

The actuator is of the same general type as that disclosed in U.S. Pat. No. Des. 216,950, issued Mar. 24, 1970 to Theodore Beck.

Now focusing on the portion of the structure shown embodying the invention, as shown best in FIGS. 1, 3, 4 and 6, the actuator is formed under its skirt with a depending latch 30. As shown, the latch is formed integrally with the mushroom-shaped actuator. Preferably, the actuator and latch are molded from a plastic that is somewhat resilient in thin unsupported sections but rigid in supported or thick sections. An example of such a plastic is polypropylene.

As shown, the latch has a generally cylindrical base but is reduced in dimension as its distal end is approached so that it presents a quite flexible downward leg having at its distal end an inwardly-facing hook or nib 32, the upper surface of which presents an upwardly-facing hooking section 34.

In operation, the side of the actuator above the latch which may be marked "Lock On" is pressed causing the end of the latch to engage the top of the curved lip 14 (FIG. 3) and to slide down the outside of it as the actuator is further pressed. The tilting of the actuator to this degree, of course, turns the valve "on" causing liquid to spray out through the orifice 24. When the nib or hook 32 snaps past the underside of the edge 14*a* and even after removal of finger pressure, the actuator is held in the "on" condition with the valve tilted, continuously dispensing product through orifice 24.

Figure 2:
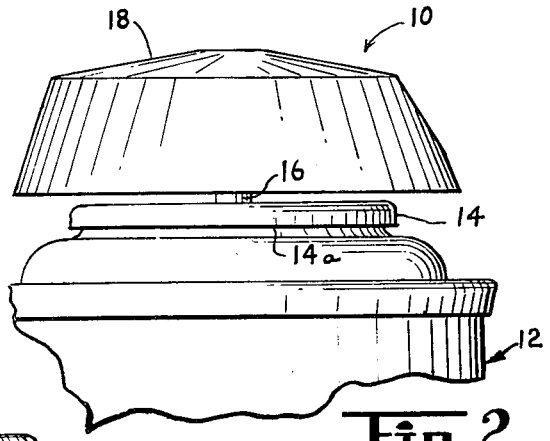
FIG. 2 is a fragmentary reduced view showing the assembly in elevation.

Often, it is desired to hold the aerosol valve in the "on" condition until the contents of the container are exhausted. This is often the case with fumigants and insecticides. However, if it is desired to interrupt the flow of product, it is only necessary to apply finger pressure to the opposite side of the actuator which may be marked "Release". This causes the somewhat flexible latch structure to yield permitting the rib 32 to slide over the edge 14*a*. The actuator is thus permitted to return to its original condition as shown in FIG. 2 wherein the valve is off.

An important benefit of the invention over the prior art is the ability of the actuator to be released by simple finger pressure without the need for two-handed operation. In addition, of course, the actuator is steamlined and attractive in appearance.

Other variations of the invention are possible and will be readily perceived by those skilled in the art. The present invention is limited only by the following claim language or its equivalents:

I claim:

1. An aerosol dispenser comprising a container having a valve mounting cup crimped to the upper end of the container in a circular bead, the cup having a tiltable discharge stem, and a generally mushroom-shaped actuator having a hub with a central passage fitting snugly over the stem and providing an outlet orifice for the dispenser, the actuator being rigid and having adjacent its periphery a downward leg having latch element integral therewith, the latch element comprising a circular base and tapered distal end terminating in an inwardly facing hook, whereby downward pressure movement of the side of the actuator over the latch causes the tilting of the valve stem and the locking of the latch under the edge of the bead to hold the valve on, continuously discharging the container, and subsequent downward movement of the actuator on the side opposite the latch breaks the latch away from the bead to turn off the valve.

2. An aerosol dispenser comprising a container surmounted by a valve mounting cup crimped to the container in a circular bead having a downward edge, the cup having a tiltable discharge stem and a generally circular actuator having a hub with a central inlet fitting snugly over the stem and connected to an outlet orifice for the dispenser, the actuator extending outward from the hub and being substantially rigid and having adjacent its periphery a downward latch integral therewith, the latch terminating in an inward-facing hook, whereby downward movement of the latch side of the actuator causes the tilting of the valve stem and the locking of the hook under the edge of the bead to hold the valve "on", continuously discharging the container, and subsequent downward movement of the actuator on the side opposite the latch disengages the hook away from the edge to turn "off" the valve.

3. A rigid plastic actuator having a mushroom-shape with a hollow stem terminating outwardly in a discharge orifice, the stem being adapted to fit over the tilt-type tubular discharge of an aerosol dispenser, the actuator having on its underside adjacent its periphery an inwardly-directed upwardly-facing hooking surface, the inner edge of which is adapted to grip under the outer margin of the mounting cup of the dispenser valve when the actuator is tilted by pressure against the actuator over the hooking surface and adapted to release the margin when the actuator is pressed on the opposite side, whereby the valve is held in the "on" condition while the hooking surface is in the gripping position.

* * * * *